US006090178A

United States Patent [19]

Benini

[11] Patent Number: 6,090,178

[45] Date of Patent: Jul. 18, 2000

[54] FRANGIBLE METAL BULLETS, AMMUNITION AND METHOD OF MAKING SUCH ARTICLES

[75] Inventor: Joseph C. Benini, Kersey, Pa.

[73] Assignee: SinterFire, Inc., Kersey, Pa.

[21] Appl. No.: 09/186,366

[22] Filed: Nov. 5, 1998

Related U.S. Application Data

[62] Division of application No. 09/063,924, Apr. 22, 1998, abandoned.

[51] Int. Cl.[7] ..... B22F 3/02

[52] U.S. Cl. ..... 75/245; 75/247; 102/517; 419/2; 419/44

[58] Field of Search ..... 75/245, 246, 247; 419/44; 102/517

[56] References Cited

U.S. PATENT DOCUMENTS

| | | | |
|---|---|---|---|
| 2,409,307 | 10/1946 | Patch et al. . | |
| 3,123,003 | 3/1964 | Lange, Jr. et al. . | |
| 3,216,358 | 11/1965 | Findeisen . | |
| 3,338,167 | 8/1967 | Jungermann et al. . | |
| 3,439,619 | 4/1969 | Bock et al. . | |
| 3,951,035 | 4/1976 | Dautzenberg et al. . | |
| 4,112,846 | 9/1978 | Gilbert et al. . | |
| 4,850,378 | 7/1989 | Dinkha et al. | 102/501 |
| 4,958,572 | 9/1990 | Martel | 102/529 |
| 5,078,054 | 1/1992 | Ashok et al. | 102/517 |
| 5,237,930 | 8/1993 | Bélanger et al. | 102/529 |
| 5,399,187 | 3/1995 | Mravic et al. | 75/228 |
| 5,616,642 | 4/1997 | West et al. | 524/439 |
| 5,665,808 | 9/1997 | Bilsbury et al. | 524/439 |
| 5,679,920 | 10/1997 | Hallis et al. | 102/506 |

OTHER PUBLICATIONS

SCM Metal Products, Inc. Brochure, "Premixed Bronze Powders for P/M Bearings," (1996).

*Primary Examiner*—Ngoclan Mai
*Attorney, Agent, or Firm*—Finnegan, Henderson, Farabow, Garrett & Dunner, LLP

[57] ABSTRACT

A frangible metal bullet, a method for making it, and ammunition made therefrom. The frangible metal bullet is formed from a mixture of metal particles and metal or metalloid binder forming material which is compacted into the desired shape, heated to a temperature above that needed to form at least one intermetallic compound but below the temperature of joining of the metal particles by sintering and below the temperature of formation of substantial amounts of a ductile alloy of the metal of the particles and the metal or metalloid binder forming material and then cooled. Such bullets have sufficient strength to maintain their integrity during firing but disintegrate into powder on impact and can be formulated to be lead-free.

23 Claims, 1 Drawing Sheet

FRANGIBLE METAL BULLETS, AMMUNITION AND METHOD OF MAKING SUCH ARTICLES

RELATED APPLICATIONS

This is a divisional application of U.S. patent application Ser. No. 09/063,924, filed Apr. 22, 1998 now abandoned.

BACKGROUND OF THE INVENTION

The present invention relates to frangible metal articles, and, in particular, to frangible bullets having particular use in target and/or training applications. Indoor and outdoor shooting applications benefit from the absence of lead as well as the frangibility (break-up) characteristics. Frangible bullets for such uses are well known. They are characterized by the use of metal powder consolidated into a bullet that has sufficient strength to maintain its integrity during firing while fragmenting on impact with a solid object having sufficient mass and rigidity to fracture the bullet.

Conventional, full-density, cast, swaged, copper plated or copper jacketed lead bullets are also used in indoor firing ranges and for training. In order to protect the shooters from ricochets, a "bullet trap" is normally required to stop the projectile and any resulting fragments from injuring shooters. Furthermore, the walls of the firing range or training facility may be covered with rubber or some other projectile absorbing material to stop occasional ricocheting bullet fragments. Thus, the cost of constructing and maintaining indoor target/training ranges is substantial. Moreover, even using bullet traps and ricochet absorbing materials on the walls, occasionally a ricochet will somehow defeat such systems and injure a shooter.

Shooting lead bullets causes the emission of airborne lead dust that is introduced into the atmosphere. This requires the implementation of elaborate ventilation systems and may require individuals working in such facilities to undergo blood monitoring programs to determine the amount of lead in their bloodstream. The accumulation of spent lead bullets and bullet fragments must be properly disposed of and regulations concerning the disposal of lead waste are becoming increasingly complex. Thus, the generation of lead dust and the accumulation of spent lead bullets and fragments causes environmental concerns and poses the potential for serious health problems.

There has been a long-standing search for a material to use as a bullet that does not contain lead. One problem in replacing lead in ammunition is that the replacement material must be sufficiently heavy such that ammunition using such bullets, when used in automatic or semi-automatic weapons, will be able to cycle the weapon properly.

The main criteria for the ability of a round to cycle automatic or semi-automatic weapons is the amount of energy that the ammunition delivers to the cycling mechanism. For some types of weapons, this energy is delivered by the expanding gases pushing back the cartridge case. For some others, the recoil is used and for still others high-pressure gases are connected, through a port inside the barrel, to a mechanism that cycles the firearm.

All firearms, are designed to function with bullets and propellants (gunpowder) that produce certain pressure-vs-time characteristics. Using a lighter bullet may cause problems in operation of a semi-automatic or automatic weapon if there is too low an energy transfer to give the mechanism the needed energy to cycle. While the energy can be increased by the use of additional propellant or different types of propellants, this is not desirable because the characteristics of such a training round would be significantly different from the ammunition having conventional bullets and propellants.

In addition, in order to replace lead in a bullet, the selected material should have a large enough specific gravity so that the resulting bullet mass is compatible with commercially available propellants. It is not economically feasible to develop a lead-free round where a special propellant or other component would need to be developed.

Further, a lead-free, training round should break up into small particles when it hits a hard surface. The individual particles are then too light to carry enough energy to be dangerous. On the other hand, such bullets should be sufficiently strong to withstand the high accelerations that occur on firing, ductile enough to engage the barrel rifling and durable enough to retain the identifying engraving from the rifling as required by government agencies.

Practice and training rounds employing combinations of resinous binders and metallic powders have generally not proven satisfactory because of uncontrollable frangibility characteristics, insufficient strength, increased fouling of the barrel of the weapon, decreased barrel longevity and inability to retain or receive engraving from the rifling of the barrel through which it is fired.

SUMMARY OF THE INVENTION

Accordingly, the present invention is directed to a frangible metal bullet, and a method of making same, which substantially obviates one or more of the limitations and disadvantages of the prior art.

Additional features and advantages of the invention will be set forth in the description which follows, and in part will be apparent from the description, or may be learned by practice of the invention. The objectives and other advantages of the invention will be realized and attained by the article and method particularly pointed out in the written description and claims thereof as well as the appended drawings.

To achieve these and other advantages and in accordance with the purpose of the invention, as embodied and broadly described, the present invention is directed to a frangible metal bullet and a method for making it. The bullet comprises a plurality of metal particles and a brittle binder. Preferably the brittle binder consists essentially of at least one intermetallic compound formed from the metal particle and a binder forming material. The binder forming material is a metal or metalloid that forms a brittle binder at a treatment temperature below the temperature of joining of the metal particles, below the temperature of formation of substantial amounts of a ductile alloy (of the metal) of the metal particles and the binder forming material and above the temperature at which the binder forming material and the metal particles form at least one intermetallic compound that joins the metal particles into a coherent, frangible article. According to the method of making the article, the metal particles and powdered binder forming material are compacted to the shape of the metal article, then heated to the treatment temperature for a time sufficient to form at least one brittle intermetallic compound, and then cooled to form the frangible metal bullet.

In further aspects of the invention, the metal particles are metals or metal-base alloys selected from copper, iron, nickel, gold, silver, lead, chromium and their alloys; and preferably copper or copper-based alloys, and the binder forming material consists essentially of materials selected from tin, zinc, gallium, germanium, silicon, arsenic, aluminum, indium, antimony, lead, bismuth, and their alloys and preferably tin or tin-based alloys.

Another embodiment is a frangible metal bullet comprised of a plurality of unsintered metal particles and at least one intermetallic compound binder joining the metal particles to form the metal bullet.

In further aspects of this embodiment, the binder has a microstructure of a porous, brittle material and the final treated product using such a binder has a transverse rupture strength of less than 13,000 psi. Frangible bullets having such properties are fractured into a plurality of particles by brittle failure of the binder, such that the fracture absorbs the majority of the kinetic energy of the bullet.

In still a further embodiment, the invention is a method of making a frangible, metal bullet, comprising the steps of: forming a mixture comprising metal particles, for example, copper and copper alloys and a metal binder forming material, the metal binder forming material comprising metals and alloys, disposed to form intermetallic compounds with the metal of the metal particles, for example, tin and tin alloys. The mixture composition is disposed to form a brittle binder at a treatment temperature below the temperature of joining of the metal particles, below the temperature of formation of substantial amounts of a ductile alloy of the metal of the metal particles and the metal binder forming material but above the temperature needed to form at least one intermetallic compound of the metal and the metal binder forming material. The mixture is compacted to form a shaped green compact, heated to the treatment temperature for a time sufficient to form an effective amount of at least one intermetallic compound, thereby forming a shaped metal precursor; and returning the shaped metal precursor to room temperature to form the metal article.

In one aspect of this embodiment, the dimensions of the shaped green compact are within 0.2% of the dimensions of the frangible metal article.

In further embodiments of the method of the invention, the dimensions of the green compact are within 0.2% of the dimensions of the frangible metal bullet.

It is to be understood that both the foregoing general description and the following detailed description are exemplary and explanatory and are intended to provide further explanation of the invention as claimed.

BRIEF DESCRIPTION OF THE DRAWINGS

The accompanying drawings are included to provide a further understanding of the invention and are incorporated in and constitute a part of this specification, and together with the description serve to explain the principles of the invention.

DESCRIPTION OF THE PREFERRED EMBODIMENTS

Figure 1:
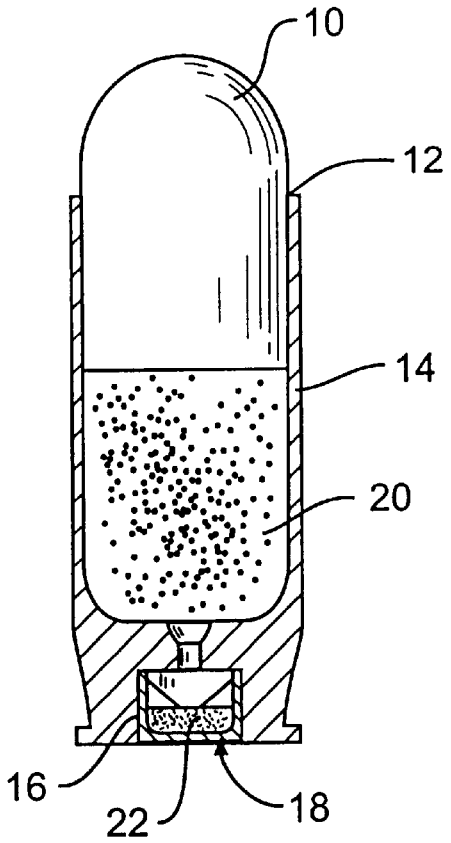
FIG. 1 is a cross-sectional view of a center-fire cartridge that includes a bullet of the invention.

Reference will now be made to preferred embodiments of the invention.

In accordance with the present invention, a frangible metal bullet is provided which comprises a plurality of metal particles joined together by a binder. The binder forming material is disposed to form a transient liquid phase at a treatment temperature below the temperature of joining of the metal particles through sintering, below the temperature of formation of a significant amount of a ductile alloy of the binder forming material and the metal particles but above the temperature of formation of at least one intermetallic compound of the metal of the metal particles and the binder forming material. For purposes of this invention a significant amount of such a ductile alloy is an amount that renders the resulting structure ductile to the point where the final treated bullet is no longer frangible. For example, in an embodiment where the metal particles are copper and the binder forming material is tin, a treatment temperature of 230 to 430° C. produces a transient liquid phase, initially just of liquid tin, without any appreciable copper particle/copper particle bonding. The liquid tin subsequently receives copper and forms a first intermetallic compound in solid form on the surface of the copper particles. Diffusion of copper into and through the initial intermetallic compound forms additional intermetallic compounds and, depending on the temperature and time the entire amount of liquid tin may be transformed into a solid comprised of at least one intermetallic compound of copper and tin. If the article is cooled before such transformations are complete a portion of the tin may solidify in the form of a metal but the intermetallic compound or compounds on the surface of the copper particles. The amount of intermetallic compound or compounds in relation to the amount of solid tin will determine if the article is frangible or ductile. In addition, the time and temperature of treatment should be such that there is no appreciable formation of an alpha bronze phase in the microstructure. If there were appreciable amounts of alpha bronze phase, it would dramatically reduce the frangibility of the bullet by significantly increasing the ductility and the transverse rupture strength of the treated article.

The metal particles and the binder forming material are compacted together into the shape of the bullet and then heated to the treatment temperature for a time sufficient to form an effective amount of the transient liquid phase of the binder forming material and then cooled to form the bullet. An effective amount of the transient liquid phase of the binder is that amount sufficient to adhere the metal particles into a coherent body when the transient liquid phase of the binder forms at least one intermetallic compound. Such an amount does not preclude there from being minor amounts of metal particle/metal particle bonding but the mechanical properties of the metal article are determined more by the mechanical properties of the binder than the strength of any metal particle/metal particle bonding in the metal article.

In a preferred embodiment of the invention, the metal article is a frangible, lead-free, metal bullet. The metal particles are unsintered and the metal binder is a brittle intermetallic compound. For purposes of the present invention the term "brittle" includes materials that, at ambient temperatures, exhibit low fracture toughness, low ductility or low resistance to crack propagation.

Another preferred embodiment of the invention, is a frangible, lead-free, metal bullet loaded in a cartridge. As embodied in FIG. 1, a conventional centerfire cartridge is depicted using the bullet of the present invention, however, the invention can also be used in rimfire cartridges (not shown). The bullet 10, here a round-nose 9 mm bullet, is inserted in the case mouth 12. The case 14 can be crimped (deformed inwardly) at the case mouth 12 to assist in retaining the bullet at the desired depth of insertion into the case 14. The bullets of the present invention have sufficient strength and ductility to withstand the crimping operation without fracturing during crimping. The case further includes a primer pocket 16 into which a separate primer 18 can be inserted. The case Depicted in FIG. 1 is a straight-walled case typical of pistol ammunition. Bullets of the present invention are also useful as rifle ammunition and for such ammunition the case may be a "bottle necked" cartridge (not shown) with the case mouth having a diameter less than the body of the cartridge case. The propellant (gunpowder) 20 is placed in the body of the cartridge case 14. It is preferred that the primer 18 be lead-free. Thus, if the bullet 10 is also lead-free the firing of such a cartridge generates no lead. Such primers are manufactured by CCI Industries of Lewiston, Id., U.S.A. and are designated as Cleanfire® primers. As here embodied the primer 18 includes a lead-free primer composition 22, however, a rimfire cartridge would have such a composition inside the rim of the cartridge itself (not shown).

Preferably, the metal particles of the invention consist essentially of metals or metal base alloys selected from copper, iron, nickel, gold, silver, lead, chromium, and their alloys, preferably copper, iron, nickel, and chromium and most preferably copper and copper alloys. In a further preferred embodiment of the invention, the binder material consists essentially of metal, metals, metal-based alloys, metalloids and mixtures and alloys thereof that will form at least one intermetallic compound with the metal of the metal particles. Such materials may be selected from tin, zinc, gallium, germanium, silicon, arsenic, aluminum, indium, antimony, lead, bismuth, and their mixtures and alloys, most preferably tin and tin alloys It is an important feature of the present invention that the frangible metal bullet, while maintaining its integrity during firing is rendered into a plurality of particles by brittle failure of the brittle binder upon impact of the bullet with an object, thereby avoiding problems of ricocheting encountered when using conventional cast or swaged ammunition. This fracturing of the frangible metal bullet into a plurality of particles further absorbs the majority of the kinetic energy of the bullet thereby essentially eliminating the possibility of the bullet, or pieces of the bullet, ricocheting. Because of the porous microstructure of the metal article of the invention, it is also able to retain various lubricants, such as molybdenum disulfide, Teflon®, and carbon, to facilitate its passage through the barrel of the weapon.

The microstructure of such materials after appropriate thermal treatments for the particular metal particle/binder combination is characterized by solid metal particles adhered one to the other by binder material that consists essentially of at least one intermetallic compound. Such systems are preferred because they render the appropriately heat treated material frangible. The binder may be fully dense or porous.

Figure 2:
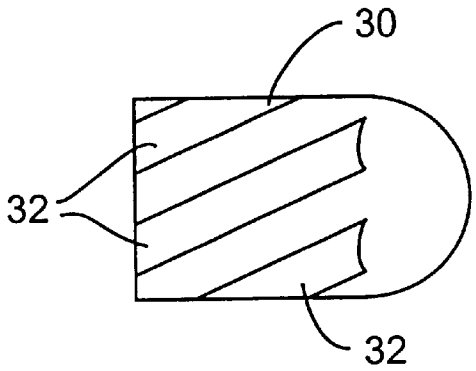
FIG. 2 is a side view of a discharged bullet of the invention, illustrating retention of the engraving from the barrel rifling.

In addition to the mechanical properties described above, the frangible metal bullet of the invention possess sufficient strength due to the binder employed, to withstand automatic or manual loading of the bullet into a cartridge, maintain its integrity during firing and to receive and retain the engraving from the rifling of the barrel of the weapon from which it is fired as shown in FIG. 2. FIG. 2 depicts a schematic view of a 9 mm pistol bullet 30 with grooves 32 on its outer peripheral surface. These grooves 32 are formed by the rifling in the gun barrel as the bullet passes through the barrel and are normally characteristic of the particular barrel that fired the bullet. This latter feature is a particular consideration in law enforcement where it is considered essential that it be possible to identify particular weapons from which bullets have been discharged.

In accordance with the present invention, the frangible metal bullet is formed by a method comprising forming a mixture of the metal particles and binder forming materials to form a transient liquid phase at a treatment temperature below the temperature of sintering neck growth of the metal particles and above the temperature at which at least one intermetallic compound of the metal of the metal particles and the binder forming materials are formed. The mixture is then compacted, under pressure using known compacting techniques, such as die compaction, rotary screw compaction, isostatic pressing, to form a shaped green compact. The green compact is heated to the treatment temperature for a time sufficient to form an effective amount of the transient liquid phase and then at least one intermetallic compound thereby forming a shaped metal precursor. The shaped metal precursor is then returned to room temperature to form the metal article of the invention which can be a frangible, lead-free metal bullet. The treatment temperature and duration of heating will, of course, depend on the selection of metal particles and binder forming material. The treatment temperature will be below the temperature at which the metal particles join to one another by sintering, below the temperature of formation of substantial amounts of a ductile alloy of the metal of the metal particles and the binder forming material and above the temperature at which at least one intermetallic compound of the metal of the metal particles and the binder forming material is formed. This has the beneficial effect of there being very little dimensional change taking place as the result of the thermal treatment of the green compact.

In a preferred embodiment of the invention the metal particles consist essentially of copper and the binder material consists essentially of tin and the green compact is heated to a temperature in the range of 150 to 430° C. for up to sixty minutes to form a brittle binder consisting essentially of at least one intermetallic compound.

As noted above, a particular advantageous aspect of the present invention is that the frangible metal article retains essentially the shape and dimensions of the shaped green compact. Thus, the shape and dimensions of the tooling that forms the shaped green compact can be the same as the desired final product. In accordance with the invention, the dimensions of the frangible metal article are within 0.2% of the dimensions of the shaped green compact.

The following examples are illustrative of the invention.

EXAMPLE 1

A number of frangible metal bullets were formed in accordance with the invention using a commercial bronze premix (PMB-8, OMG Americas, Research Triangle Park, North Carolina, U.S.A.) The components of the premix were 89.75 weight percent copper particles, 10 weight percent tin particles and 0.25 weight percent zinc stearate lubricant. The lubricant was present to aid in compaction and ejection of the green compact and was substantially removed during subsequent heat treatment. The premix had particle sizes of about 8% greater than 250 mesh, about 30% greater than 325 mesh, with the balance less than 325 mesh.

The mixture was compacted using a standard straight-walled die in a mechanical press that was later determined to exert a gross load of approximately 20 tons. The die formed the mixture into a number of green compacts of the size and configuration of a 9 mm bullet. The green compacts were then heated at a temperature of 260° C. for 30 minutes in a nitrogen atmosphere, at which time the total weight of the binder had been transformed into a transient liquid binder phase and ultimately into at least one intermetallic compound of copper and tin. The treated compacts were then cooled to room temperature, resulting in a 9 mm bullets weighing 105 grains (6.80 grams) deviating less than 0.1% from the original dimensions of the green compact.

The bullets were loaded into a brass cartridges with 4.5 grains of Hercules Bullseye® powder and were crimped. The resulting ammunition was test fired from several different weapons (including semi-automatic and full automatic weapons) against a 0.25 inch steel barrier. The ammunition operated without malfunction, feeding, firing and ejecting without problems. Upon impact with the barrier the bullets completely disintegrated into fine powder.

EXAMPLES 2–4

The same material formed into bullets in Example 1 was formed into standard transverse rupture strength test bars. The samples were tested in the green condition (compacted but without a heat treatment) (Example 2), after the same heat treatment of Example 1, a temperature of 260° C. for 30 minutes in a nitrogen atmosphere (Example 3) and after a heat treatment at a temperature of 810° C. for 30 minutes in a nitrogen atmosphere (Example 4). The following properties were determined—the density, the percentage dimensional change from the die size (as describe in ASTM B610, MPIF 44, or ISO 4492), the Rockwell H hardness (HRH) and the transverse rupture strength (TRS) in units of pounds pers square inch (psi) as determined according to ASTM B528, MPIF 41, or ISO 3325). The Rockwell H hardness scale is based on the use of a 118 inch ball indenter and a load of 150 Kg (ASM Metals Handbook).

| Example | Density | Size change | HRH(ave.) | TRS |
|---|---|---|---|---|
| 2 | 7.26 g/cc | 0.14% | 73.7 | 3,651 psi |
| 3 | 7.27 g/cc | 0.07% | 94.8 | 12,710 psi |
| 4 | 6.53 g/cc | 2.53% | 52.7 | 32,625 psi |

The above data indicates that the embodiment using an approximate 90/10 copper/tin mixture, conventionally compacted and then heat treated at a temperature of 260° C. for 30 minutes, produces a bullet of acceptable frangibility when the transverse rupture strength of the treated article is approximately 13,000 psi or less. Transverse rupture strengths greater than 13,000 psi are operable for frangible bullets but are not preferred.

Metallography on other samples confirmed that, in the copper/tin system, the tin initially melted and the liquid tin infiltrated the spaces around the copper particles. Copper then diffused into the liquid tin and formed at least a first intermetallic compound that solidified as a layer on the copper particles. Liquid tin may still be present and it is believed that the first intermetallic compound may melt as more copper and tin diffuse into the first intermetallic compound to form a second intermetallic compound. At the treatment temperature tin continues to diffuse toward the copper particles forming voids in the binder. Depending on the amount of tin in the mixture, the treatment temperature and the time at the treatment temperature elemental tin will disappear and at least one intermetallic compound will be formed. Such intermetallic compounds have little ductility, low fracture toughness and a low resistance to crack propagation. Because such materials comprise the binder joining the metal particles and the metal particles are not otherwise bound by a ductile material (either through particle/particle bonding or bonding with a ductile binder) the joined article is frangible. Moreover, the volume changes associated with the creation of intermetallic compounds and porosity can be manipulated to form articles that do not significantly change dimensionally during the formation of the bonded article.

The copper/tin phase diagram indicates that at equilibrium a number of different intermetallic compounds can be formed. While not limiting the invention to the embodiment disclosed and not wishing to be bound by theory, it is believed that the intermetallic compound present in the preferred embodiment is what is known on an equilibrium phase diagram as the eta phase. The thermal treatments described herein may or may not result in equilibrium structures but the species of the intermetallic compound or intermetallic compounds or the existence of non-equilibrium phases is not as significant to the invention as are the effects such materials, when used as binders, have on the mechanical properties and dimensions of the articles formed therefrom. Thus, the binders of the invention can be mixtures of intermetallic compounds, a single intermetallic compound or a brittle mixture of some phase with an intermetallic compound.

Additional advantages and modifications of the disclosed embodiments may occur to those skilled in the art. Specific intermetallic compounds or combinations thereof may be later found to be advantageous. Such materials are within the scope of the present invention. The invention, in its broader aspects, is therefore not limited to the specific materials, details, embodiments and examples shown and described. Accordingly, departures may be made from such that specifically disclosed without departing from the scope of the invention as defined by the appended claims and their equivalents.

What is claimed is:

1. A frangible metal bullet comprising:

a plurality of metal particles;

a brittle binder for joining said metal particles, said binder consisting essentially of at least one intermetallic compound.

2. The frangible metal bullet of claim 1 wherein said metal particles and a metal or metalloid binder forming material are compacted to the shape of a bullet, then heated to a treatment temperature for a time sufficient to form an effective amount of at least one brittle intermetallic compound upon cooling, and then cooled to form said frangible metal bullet.

3. The frangible metal bullet of claim 2 wherein said metal particles consist essentially of metals or metal-base alloys selected from the group consisting of copper, iron, nickel, gold, silver, lead, chromium and their alloys.

4. The frangible metal bullet of claim 2 wherein said metal or metalloid binder forming material consists essentially of a material selected from the group consisting of: tin, zinc, gallium, germanium, silicon, arsenic, aluminum, indium, antimony, lead, bismuth, their mixtures and their alloys.

5. The frangible metal bullet of claim 2 wherein said brittle binder consists essentially of at least one intermetallic compound of a first metal selected from the group consisting of copper, iron, nickel, gold, silver, lead, and chromium and a second metal or metalloid selected from the group consisting of: tin, zinc, gallium, germanium, silicon, arsenic, aluminum, indium, antimony, lead, and bismuth.

6. A frangible, lead-free, metal bullet comprising:

a plurality of metal particles, said metal being selected from the group consisting of: copper, copper-base alloys, iron, nickel and chromium;

a metal or metalloid binder forming material disposed to form a brittle binder comprised of at least one intermetallic compound at a treatment temperature below the temperature of metal particle to metal particle bonding or the formation of significant quantities of a binder/metal particle alloy.

7. The frangible metal bullet of claim 6 wherein said metal particles and said binder forming material are compacted to the shape of said bullet, then heated to said treatment temperature for a time sufficient to form at least one intermetallic compound upon cooling and then cooled to form said metal bullet.

8. The frangible metal bullet of claim 7 wherein said metal particles consist essentially of copper or copper-base alloys.

9. The frangible metal bullet of claim 8 wherein said binder forming material consists essentially of tin or tin-based alloys.

10. The frangible metal bullet of claim 8 wherein said binder forming material consists essentially of tin and said brittle binder comprises an intermetallic compound of copper and tin.

11. The frangible metal bullet of claim 10 wherein said intermetallic compound of copper and tin consists essentially of the eta phase.

12. A frangible metal bullet comprising:

a plurality of unsintered metal particles;

an intermetallic compound binder joining said metal particles to form said metal bullet.

13. The frangible metal bullet of claim 12 wherein said binder has a microstructure characterized as a porous, brittle, metal having at least one intermetallic compound bonding adjoining metal particles.

14. The frangible metal bullet of claim 12 wherein said metal bullet consists of a material having a transverse rupture strength of less than 13,000 psi.

15. The frangible metal bullet of claim 12 wherein said frangible metal bullet is rendered into a plurality of particles by brittle failure of said binder.

16. The frangible metal bullet of claim 15 wherein the fracture of said frangible metal bullet into a plurality of particles absorbs the majority of the kinetic energy of said bullet.

17. A method of making a frangible metal bullet, said method comprising the steps of:

forming a mixture comprising metal particles and a metal or metalloid binder forming material disposed to form at least one intermetallic compound at a treatment temperature below the temperature for joining said metal particles and formation of substantial amounts of a ductile alloy of said metal particles and said binder forming material;

compacting said mixture to form a green compact in the shape of said bullet;

heating said green compact to said treatment temperature for a time sufficient to form an effective amount of at least one brittle intermetallic compound, thereby forming a shaped metal precursor; and returning said metal precursor to room temperature to form said frangible metal bullet.

18. The method of making a frangible metal bullet as set out in claim 17, wherein said metal particles consist essentially of copper, and said binder forming material consists essentially of tin.

19. The method of making a frangible metal bullet as set out in claim 17, wherein the dimensions of said green compact are within 0.2% of the dimensions of said frangible metal bullet.

20. A lead-free cartridge comprising:

a cartridge case having a neck;

a lead-free primer composition;

propellant within said case; and a frangible, lead-free, metal bullet comprised of a plurality of unsintered metal particles joined with a brittle binder consisting essentially of at least one intermetallic compound formed from a binder forming material, said metal particles comprising a metal selected from the group consisting of copper, iron, nickel, chromium, tungsten and their alloys, said bullet being in said case neck.

21. The cartridge of claim 20 wherein said binder forming material comprises a material selected from the group consisting of: tin, zinc, gallium, germanium, silicon, arsenic, indium, aluminum, antimony, bismuth and their mixtures.

22. The cartridge of claim 20 wherein said cartridge is a centerfire cartridge having a primer pocket with a primer therein.

23. The cartridge of claim 20 wherein said cartridge is a rimfire cartridge.

* * * * *